US005443657A

United States Patent [19]

Rivenburg et al.

[11] Patent Number: 5,443,657

[45] Date of Patent: Aug. 22, 1995

[54] POWER SOURCE USING A PHOTOVOLTAIC ARRAY AND SELF-LUMINOUS MICROSPHERES

[76] Inventors: Howard C. Rivenburg, 32 Berrien Ave., Princeton Junction, N.J. 08550-1302; Paul Bilhuber, 89 Claremont Ave., Maplewood, N.J. 07040; Edward F. Divers, III, 14022 Vista Dr., #70A, Laurel, Md. 20707; Michael Arneson, 1500 Conrose Dr., Westminster, Md. 21157

[21] Appl. No.: 121,486

[22] Filed: Sep. 16, 1993

[51] Int. Cl.[6] ..... G21H 1/12

[52] U.S. Cl. ..... 136/253; 310/303

[58] Field of Search ..... 136/253; 310/303

[56] References Cited

U.S. PATENT DOCUMENTS

| | | | |
|---|---|---|---|
| 3,031,519 | 4/1962 | Silverman | 136/253 |
| 3,497,392 | 2/1970 | Walker | 136/253 |
| 4,242,147 | 12/1980 | De'Toia | 136/253 |
| 4,628,143 | 12/1986 | Brotz | 136/253 |
| 4,677,008 | 6/1987 | Webb | 428/35 |
| 4,900,368 | 2/1990 | Brotz | 136/253 |
| 5,082,505 | 1/1992 | Cota | 136/253 |
| 5,124,610 | 6/1992 | Conley et al. | 310/303 |

FOREIGN PATENT DOCUMENTS

| | | | |
|---|---|---|---|
| 615938 | 3/1961 | Canada | 136/253 |

OTHER PUBLICATIONS

John C. C. Fan, "Single-Cell Concepts For Obtaining Photovoltaic Conversion Efficiency Over 30%", Photovoltaic Specialists Conf., Las Vegas, Nev., Oct. 21-25, 1985, published Apr. 28, 1986, pp. 28-32.

Edward F. Divers III, "A Long Life and Wide Temperature Range Nuclear Beta Battery", 8th Annual Join Government-Industry Symposium and Exhibition on Security Technology, Jun. 3, 1992.

*Primary Examiner*—Aaron Weisstuch

*Attorney, Agent, or Firm*—Lowe, Price, LeBlanc & Becker

[57] ABSTRACT

A power source comprises at least one photovoltaic cell arranged adjacent a plurality of self-luminous microspheres containing a radioactive material such as tritium and phosphor particles. Photons generated from the phosphor particles strike the photovoltaic array which converts the light to electrical energy. The self-luminous microspheres can be arranged adjacent the photovoltaic array using a binder material. The inventive power source provides a portable, safe, and long lasting battery which is adaptable for a wide range of applications requiring a reliable power source.

6 Claims, 2 Drawing Sheets

POWER SOURCE USING A PHOTOVOLTAIC ARRAY AND SELF-LUMINOUS MICROSPHERES

FIELD OF THE INVENTION

The present invention is directed to a power source including a photovoltaic array and self-luminous microspheres and, in particular, tritium-containing and phosphor particle-containing microspheres adjacent to a semiconductor photovoltaic array for generation of electrical power.

BACKGROUND ART

The use of radioactive gas as a means to generate light is well known in the art. Typically, radio-luminescent light sources include the combination of a phosphor and a radioactive gas such as tritium enclosed within a sealed cylindrical, spherical or rectangular chamber. Tritium, a hydrogen molecule with one proton and two neutrons, is a radioactive beta emitter having a half life of about 12.3 years. One example of a radio-luminescent tritium light source is tritium-filled containers found on 747 jets for indicating the direction of exits in the case of catastrophic power failure.

Another example of a tritium light source is disclosed in U.S. Pat. No. 4,677,008 to Webb, issued Jun. 30, 1987. In this patent, tritium and at least one phosphor particle are disposed within a gas tight envelope. These self-luminous microspheres are disclosed for use on surfaces to form signs, markers, indicators and the like. In addition, a plurality of the self-luminous microspheres may be disposed in a transparent binder to form a luminous paint.

The self-luminous microspheres typically have an output, measured in foot-Lamberts as a unit of flux per unit source area, between about 1 foot-Lambert and 10 foot-Lambert.

These self-luminous microspheres also provide advantages over other prior art designs, including safety and efficiency.

It is also been proposed to use radio-luminescent light sources in conjunction with the generation of power. Direct conversion devices have been proposed wherein a semiconductor material used as a photovoltaic convertor is placed adjacent the radioactive source. Electrons from the radioactive source strike the lattice of the semiconductor imparting energy which frees electron and hole pairs. The electrons/hole pairs then create a bias voltage which can be tapped for current. Drawbacks associated with these direct conversion devices include damage to the lattice of the semiconductor as a result of impact by the high energy particles emitted from the radioactive source. In addition, when using tritium as the radioactive source, hydrogen can passivate the semiconductor material resulting in still lower efficiencies.

Indirect conversion power sources have also been proposed. In these devices, the radiation from the radioactive source first strikes a phosphor which then releases a photon of light. If the energy of the released photon of light is in the bandgap absorption wavelength, it is accepted by an adjacent photovoltaic cell and converted into an electron/hole pair with a certain energy. Efficiencies for these types of devices are generally about 10%.

U.S. Pat. No. 5,082,505 to Cota et al discloses a self-sustaining power module of the indirect conversion type. In this patent, the radioactive source is a tritium-containing capsule that interfaces with the receptor surfaces of a photovoltaic cell. The capsule has inside surfaces that are coated with phosphor and also contains the tritium gas. The tritium gas produces beta particles that bombard the phosphor causing the release of the photons. The photons, in turn, strike and cause the photovoltaic cell to generate a current flow that is then applied, via a pair of electrodes, to an external load. These devices can come in a plurality of modules to provide various output combinations.

Drawbacks associated with the prior art indirect conversion power sources include a limited area of phosphor for use since the phosphor is coated on the inside surface of the tritium-containing container. Since only one surface of the phosphor is available for photon generation, less light is produced. In addition, any generated light must diffuse through the overall phosphor coating to escape the enclosing vessel.

Furthermore, these prior art types of conversion devices also permit beta particle absorption by the tritium gas itself. Since the beta particles emitted by the tritium are weak and have a travel range of only about 5 to 30 microns, the beta particles can be absorbed by the tritium gas before striking the phosphor. At low pressures, beta particle absorption is not as prevalent since the density of the tritium gas molecules is low enough that few beta particles are absorbed. However, when using high gas pressures, the gas density increases, thereby also increasing the likelihood of absorption of the beta particles by the tritium gas.

In view of the disadvantages mentioned above, a need has developed to provide an improved power source which overcomes the deficiencies in the prior art discussed above.

In response to this need, the present invention provides a novel power source using self-luminous microspheres in combination with a photovoltaic source to provide improved energy efficiency and light output. The present invention also provides a flexible and compact form which is readily adaptable to different power requirements and shape configurations.

SUMMARY OF THE INVENTION

It is a first object of the present invention to provide an improved power source, capable of high portability and flexibility concerning end use.

It is another object of the present invention to provide an improved power source which utilizes a photovoltaic source in combination with self-luminous microspheres.

A further object of the invention is to provide a high efficiency power source capable of producing reliable and long life power requirements.

Other objects and advantages of the present invention will become apparent as the description thereof proceeds.

In satisfaction of the foregoing objects and advantages, the present invention provides a power source comprising a photovoltaic array made of a semiconductor material, having a defined shape including at least one surface and having a predetermined bandgap. A plurality of self-luminous microspheres are arranged on the surface of the photovoltaic array. Each of the self-luminous microspheres comprises a gas tight enclosure, a radioactive gas contained within the enclosure and at least one phosphor particle contained within the enclosure. The radioactive gas causes the phosphor particle to emit photons, the photons striking the photovoltaic array and generating a predetermined level of power.

In a preferred embodiment, the semiconductor material of the photovoltaic array is aluminum gallium arsenide and is doped to have a bandgap overlapping or matching the spectral emission center of the phosphor particle. Preferably, the bandgap of the aluminum gallium arsenide ranges between about 550 to 850 nanometers. A phosphor is preferably selected with a spectral emission center at about 570 nanometers with a width of about 50 nanometers. In the preferred embodiment, using a 5-element AlGaAs array with dimensions of about 1.5 centimeters wide, 5 centimeters long and about several hundred to about one thousand microns thick, power generation can range from 3 microwatts to 60 microwatts with a voltage of 5 volts.

BRIEF DESCRIPTION OF DRAWINGS

Reference is now made to the drawings accompanying the invention wherein.

DESCRIPTION OF THE PREFERRED EMBODIMENTS

The present invention is directed to a unique power source which combines a photovoltaic array and self-luminous microspheres. These self-luminous microspheres are disclosed in U.S. Pat. No. 4,677,008 hereby incorporated in its entirety by reference.

The inventive power source is advantageous over other prior art power sources using radio-luminescent light sources in its low cost, small size and high probability to meet government regulations concerning products incorporating radioactive materials such as tritium.

The inventive power source provides improved photovoltaic conversion efficiency as a result of matching the semiconductor bandgap to the spectral emission of the phosphor in the self-luminous microspheres.

The use of self-luminous microspheres with a photovoltaic array also provides the unexpected improvement of having the ability to produce the same or greater light output using less tritium. This improvement is achieved by using an increased number of smaller diameter microspheres which provide the same amount of light output as a fewer number of larger diameter microspheres but with a reduced Curie content. This reduction in Curie content is critical in determining the commercial viability of any product incorporating radio-luminescent light sources with regard to government regulation.

The reduction in Curie content also results in a decrease in manufacturing costs of the power source.

Figure 1:
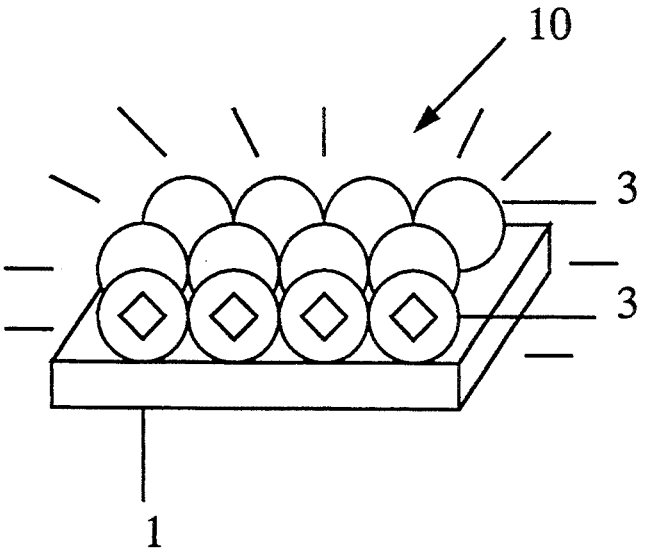
FIG. 1 is a perspective view of a plurality of self-luminous microspheres arranged adjacent a photovoltaic array.

With reference now to FIG. 1, the inventive power source is generally designated by the reference numeral 10 and is seen to include a photovoltaic array 1 supporting a plurality of self-luminous microspheres 3. Arranged within the self-luminous microspheres 3 are the phosphor particles 5. As stated above, the self-luminous microspheres are disclosed in U.S. Pat. No. 4,677,008. Since these microspheres are known, a further detailed description thereof is not deemed necessary.

Figure 2:
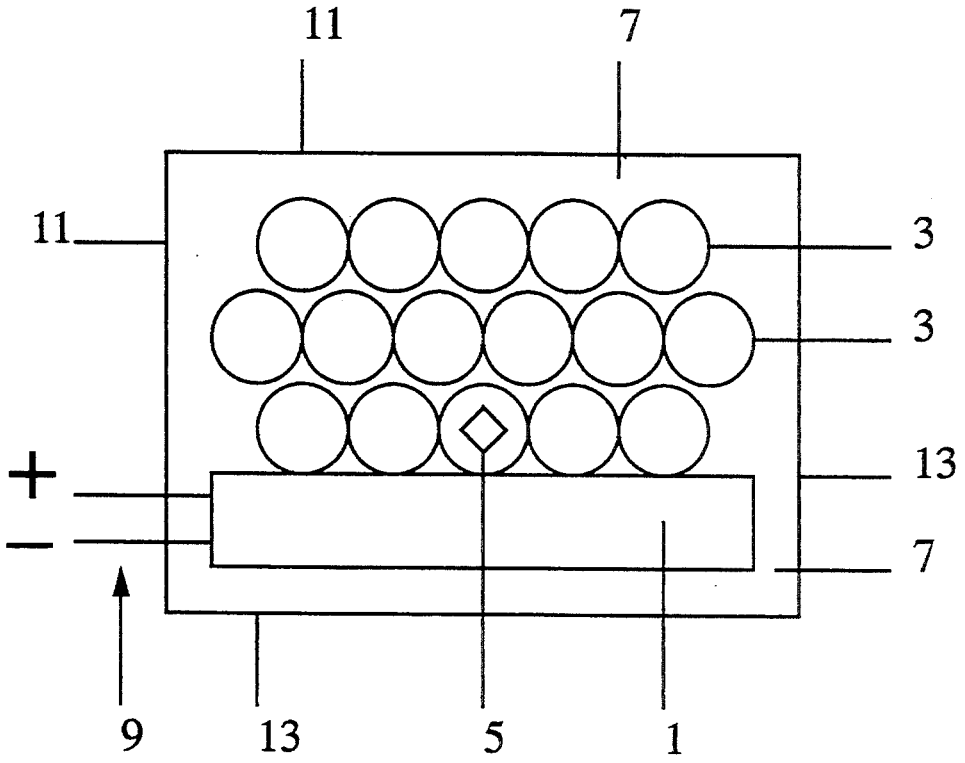
FIG. 2 is a side schematic view of the inventive power source.

It should be understood that the microspheres 3 can be arranged adjacent the photovoltaic array in any known manner, including a single layer of microspheres, multiple layers or a stacked irregular pattern. Preferably, the microspheres are arranged in a single layer to optimize light transmission to the photovoltaic array. An exemplary configuration and manufacturing method is shown in FIG. 2. Therein, the microspheres 3 and photovoltaic array 1 may be encapsulated in a binder material such as clear acrylic 7 or the like. The clear acrylic maintains integrity of the power source while positioning the microspheres adjacent the photovoltaic array for maximum efficiency. Output leads 9 are attached to the photovoltaic cell 1 from which output can be applied to an external load.

It should be understood that any known binder can be used to encapsulate the microspheres alone such that they are adjacent to the photovoltaic or both the microspheres and the photovoltaic array. Of course, other conventional methods can be employed to position the microspheres adjacent the photovoltaic array such as adhesives, containment structures, etc.

Although FIG. 2 shows exposed surfaces 11 adjacent to the self-luminous microspheres as well as surfaces 13 adjacent to the photovoltaic array, the entire power source may be partially or wholly encased in a rigid structure. When using a rigid structure adjacent the self-luminous microspheres, care should be taken to allow for dimensional changes in the self-luminous microspheres due to ambient and operating conditions. One method of assuring that the microspheres can dimensionally change without damage is to use a clear silicon gel or the like between the self-luminous microspheres and any adjacent rigid structure. The gel provides sufficient flexibility to prevent damage to the microspheres during dimensional changes. Of course, the flexible barrier silicon gel is preferably used only when the self-luminous microspheres are arranged adjacent a rigid structure. Silicon gel can also be disposed between the photovoltaic array and the microspheres if necessary. However, since the photovoltaic array has sufficient flexibility, a barrier silicon gel is typically not necessary.

In another embodiment, the binder material used for encapsulating the microspheres so that they are adjacent to the photovoltaic array can be a tritium getter material. Tritium getters are well known in the art. One example of a gettering compound is DEB, an organic compound having the formula 1–4 bis (phenylethynyl) benzene. Using a gettering material as a binder provides a dual functioning material which binds and getters simultaneously. In certain instances, it may be preferred to use a binder material that is not a getter. The absorption of tritium by the gettering material may result in a disposal problem of the gettering material which would contain any radioactive material escaping from the microspheres.

The photovoltaic array may be any known photovoltaic cell or array., for example, those disclosed in U.S. Pat. No. 5,082,505 to Cota et al, hereby incorporated in its entirety by reference. For example, silicon crystal, amorphous silicon, gallium phosphide, gallium arsenide, etc. may be utilized as the applicable semiconductor material of the photovoltaic array or cell.

In a preferred embodiment, the semiconductor material for the photovoltaic array or cell is aluminum gallium arsenide. As stated above, there exists a wide variety of semiconductor materials that can be used in the inventive power source design. However, the semiconductor materials should be the type such that the light source can deliver a sufficiently strong radiant power flux per unit area that can be efficiently converted to electrical power. Thus, one factor in providing efficient conversion to electrical power is the irradiance of the light source as well as its spectral components. The measurement of the irradiance of a light source, in particular, a phosphor will vary depending on the phosphor used in conjunction with the self-luminous microspheres. Any of the phosphors used in present generation tritium light sources can be incorporated into the self-luminous microspheres.

Using aluminum gallium arsenide semiconductor materials as the photovoltaic array or cell material optimizes the efficient conversion of light to electrical power by matching the spectral emission characteristics of the phosphor contained within the self-luminous mircospheres to the semiconductor bandgap.

The aluminum gallium arsenide semiconductor materials have a bandgap wavelength range of approximately 550 nanometers to 850 nanometers. However, the bandgap of the aluminum gallium arsenide semiconductor material can be doped to an optimized narrow bandgap to match the spectral emission characteristics of a given phosphor. For example, a LUMILUX® YELLOW FC (E3086) phosphor, (Zn, Cd)s:Cu,Al, has a strong spectral emission centered at about 570 nanometers with a width of about 50 nanometers. This phosphor can be used in the self-luminous microspheres with the aluminum gallium arsenide semiconductor material doped to match the spectral emission center of 570 nanometers of the LUMILUX® phosphor. With this correspondence of spectral emission characteristics of the phosphor and optimized narrow bandgap of the semiconductor material, an increase in photovoltaic conversion efficiency is realized.

For example, modeling a light source wherein the tritium has an overall brightness ranging from 1 foot-Lambert as a minimum to 10 foot-Lamberts, the power output of a 5-element AlGaAs array with dimensions of about 1.5 centimeters wide by 5 centimeters long and up to 1,000 microns thick has been estimated to be from 3 microwatts to 60 microwatts with a voltage of 5 volts.

The flexibility in optimizing the bandgap of the AlGaAs material to a selected wavelength range with a variance of about 10 nanometers enables the use of various types of phosphor materials while still maintaining maximum photovoltaic conversion efficiency. For example, a CdS:Ag phosphor having a broad band spectral emission peak of about 750 nanometers can be used with an aluminum gallium arsenide material doped to approximate the 750 nanometer spectral emission center of the CdS:Ag phosphor.

Since the doping of aluminum gallium arsenide material is well known in the art, further details as to the specific methods and parameters concerning doping are not deemed necessary.

With reference again to FIG. 1, although a single photovoltaic array is depicted, the number and configuration will depend on the particular application. Typically, a unit cell would be about 5 centimeters long by 1.5 centimeters wide by about 250 microns thick. A cell of this nature should be capable of generating about 50 microwatts of electrical power for 15 years. However, a number of cells may be connected in parallel or series depending on the final application. In addition, the cell configuration may be other shapes than rectangular and different widths, lengths and thicknesses. For example, a single power source can range between several hundred to a thousand microns thick.

Figure 3:
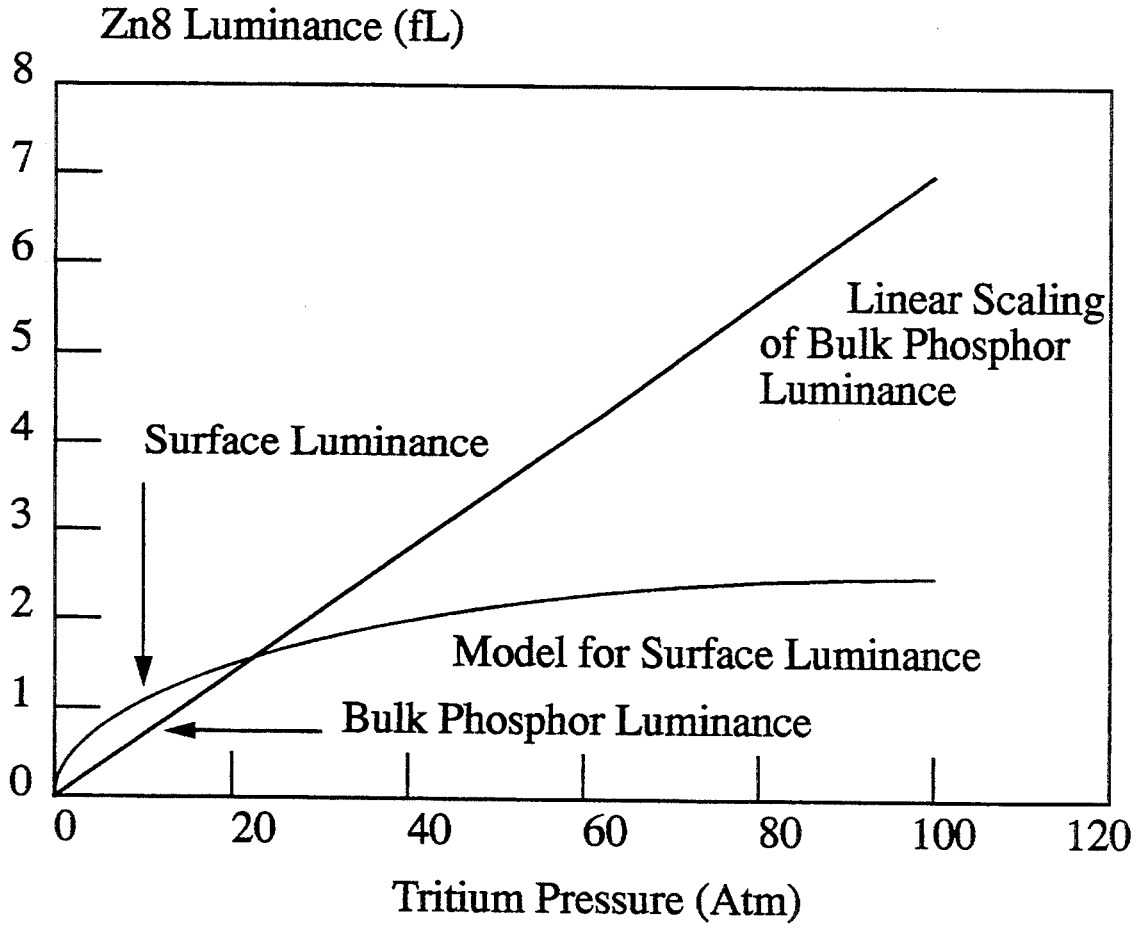
FIG. 3 is a graph relating luminance and tritium pressure for phosphor in bulk form and phosphor coated on a surface.

FIG. 3 demonstrates the improvements in luminance using self-luminous microspheres over traditional tritium-phosphor containment approaches wherein the phosphor is adhered to a surface. As is evident from FIG. 3, even at increased tritium pressures, beta particle absorption by the tritium gas prevents an increase in luminance for conventional tritium sources using phosphor-coated surfaces. The "model for surface luminance" graph reaches a plateau at approximately 2 foot-Lamberts. In contrast, increasing the tritium pressure wherein the entirety of the phosphor particle is subjected to tritium gas as is the case with self-luminous microspheres produces vast improvements in luminance, even at increasing tritium pressures.

In a preferred embodiment, the diameter of the microspheres is maintained as small as possible, typically, less than 250 microns. Using smaller-sized self-luminous microspheres provides the benefits of a light output equivalent to larger diameter spheres in combination with lower levels of radioactive material. To demonstrate the benefits of using smaller-sized self-luminous spheres, the level of tritium and light output for various sized microspheres will be compared. The comparison will be based on tritium at one atmosphere pressure. At one atmosphere pressure and 25° C., tritium gas ($T_2$) has an active density of 2.37 Ci/cm$^2$ and a specific activity of $9.62\times10^3$ Ci/g. An estimate to use concerning the volume of the microspheres is that 80% of the outside diameter measurement would adequately compensate for the wall thickness of the sphere.

For an illumination panel 3 feet long and 1.5 feet wide, approximately 4,018,064 1 millimeter diameter microspheres would be needed to form a single layer. The total Curie content of this quantity of microspheres would be 265.5 Curiers. If, however, 0.5 millimeter microspheres are used, the quantity required becomes 836,128, but the Curie content reduces to 66 Curiers. Similarly, for 250 micron and 125 micron diameter spheres, the corresponding required quantities would be 1,672,256 and 3,345,512, respectively, with Curie contents of 16.6 and 4.15 Curies. Since the light output would be the same for all of these cases, the benefits of using as small of a size of self-luminous microspheres as possible minimizes potential radioactive material hazard. It is anticipated that even sizes smaller than 125 microns could be utilized in the inventive power source.

Another advantage associated with the inventive power source is a reduction in manufacturing cost. Using the self-luminous microspheres in combination with the photovoltaic array reduces manufacturing costs since the microspheres minimize the hand or customized work required for other known-type radioluminescent materials. In addition, the use of small-sized self-luminous microspheres also results in a reduction in tritium which is the most costly component of the inventive power source. At present market value, the tritium costs about $3.00 per Curie. In the example described above using a 1 millimeter microsphere containing tritium at a pressure of 1 atmosphere, the Curie content of a single 1 millimeter microsphere is $6.35\times10^{-4}$ Curies. The tritium costs per microsphere would be approximately 0.19 cents. For each reduction in size of the microspheres, the reduction of cost per microsphere would be proportional to the decrease in Curie content. Thus, for microspheres equal to or less than 250 microns, a significant cost reduction is achieved.

With the increased brightness, very small size and dramatically lowered Curie content, the use of self-luminous microspheres integrated with photovoltaic arrays allows the development of commercial applications that are not achievable using conventionally constructed tritium-based radio-luminescent sources. Examples of commercial applications that may utilize the inventive power source include instrument panels, laptop and notebook computers, personal communication devices, survival and safety equipment and "disposable" electronics.

As such, an invention has been disclosed in terms of preferred embodiments thereof which fulfill each and every one of the objects of the present invention as set forth hereinabove and provide a new and improved power source.

Various changes, modifications and alterations from the teachings of the present invention may be contemplated by those skilled in the art without departing from the intended spirit and scope thereof. Accordingly, it is intended that the present invention only be limited by the terms of the appended claims.

We claim:

1. A power source comprising:

a) a photovoltaic array;

b) at least one self-luminous microsphere arranged on said photovoltaic array, where said at least one self-luminous microsphere is comprised of;

i) a gas-tight enclosure less than or equal to 250 microns in diameter;

ii) a radioactive gas contained within said gas-tight enclosure at a pressure of at least 30 atmospheres; and iii) at least one phosphor particle contained within said gas-tight enclosure, where the amount of radioactive material contained within said at least one self-luminous microsphere is minimized, where said radioactive gas causes said at least one phosphor particle to emit photons, where the pressure of said radioactive gas maximizes the number of photons emitted, and where the photons strike said photovoltaic array so that electrical power is generated.

2. The device of claim 1, wherein said radioactive gas is tritium.

3. The device of claim 2, wherein said photovoltaic array ms comprised of a semiconductor material.

4. The device of claim 3 wherein said semiconductor material is AlGaAs having a bandgap matched to the wavelength of the photons emitted from said at least one phosphor particle.

5. The device of claim 1, wherein said photovoltaic array is comprised of a semiconductor material.

6. The device-of claim 5, wherein said semiconductor material is AlGaAs having a bandgap matched to the wavelength of the photons emitted from said at least one phosphor particle.

* * * * *